US005535947A

United States Patent [19]

Hogue et al.

[11] Patent Number: 5,535,947

[45] Date of Patent: Jul. 16, 1996

[54] EMBEDDED RAILWAY TRACK SYSTEM

[76] Inventors: Thomas A. Hogue, 702 Williamsburg, Ennis, Tex. 75119; William K. Hull, 645 Chestnut Ave. #204, Long Beach, Calif. 90802

[21] Appl. No.: 548,435

[22] Filed: Oct. 26, 1995

Related U.S. Application Data

[62] Division of Ser. No. 230,393, Apr. 20, 1994.

[51] Int. Cl.[6] ..... E01B 1/00

[52] U.S. Cl. ..... 238/2; 238/8; 238/9

[58] Field of Search ..... 238/2, 5, 6, 7, 238/8, 9

[56] References Cited

U.S. PATENT DOCUMENTS

| | | | |
|---|---|---|---|
| 1,612,274 | 12/1926 | Fischer | 238/9 |
| 2,950,057 | 8/1960 | Speer | 238/8 |
| 4,093,120 | 6/1978 | Canfield | 238/8 |
| 4,236,670 | 12/1980 | Limmergard | 238/8 |
| 4,368,845 | 1/1983 | Perry et al. | 238/8 |
| 4,415,120 | 11/1983 | Thim | 238/8 |
| 4,461,421 | 6/1984 | Maass | 238/8 |
| 4,606,498 | 8/1986 | Grant et al. | 238/8 |
| 4,793,545 | 12/1988 | Raymond | 238/8 |
| 4,846,401 | 7/1989 | Kennel | 238/7 |
| 4,880,158 | 11/1989 | Cook | 238/8 |
| 4,899,933 | 2/1990 | Martin | 238/8 |
| 5,181,657 | 1/1993 | Davis | 238/8 |
| 5,201,467 | 4/1993 | Kennel et al. | 238/8 |
| 5,282,569 | 2/1994 | Kiyota | 238/2 |

OTHER PUBLICATIONS

Epton Industries, Inc., Literature: *Epflex Railseal Interface*, Apr. 14, 1988.

Bechtel Corp., Drawing: *Modified Embedded Track System For Restraining Rail In U–Wall*, 1992 (est.).

OMNI Rubber Products, Inc., Drawing: *Railguard Rubber/ Concrete Grade Crossing System Drawing*, Aug. 21, 1991.

Extrud–A–Rail Inc., p. 31, *Railway Age*, Feb. 1991.

Magnum Manufacturing Corp., Drawings, Date Unknown.

*Primary Examiner*—Robert J. Oberleitner
*Assistant Examiner*—S. Joseph Morano
*Attorney, Agent, or Firm*—Jenkens & Gilchrist

[57] ABSTRACT

A pair of rails are secured on a plurality of perpendicularly disposed ties which rest on a ballast material. A gauge panel is disposed between the rails and has a top surface which is substantially the same height as the rails. Field inserts are positioned on the outside of the parallel rails and field panels, which have a top surface that is substantially the same height as the rails, are positioned in contact with the field inserts. Gauge inserts are inserted into the space between the gauge panel and the parallel rails.

2 Claims, 5 Drawing Sheets

EMBEDDED RAILWAY TRACK SYSTEM

This is a divisional application of U.S. Ser. No. 08/230,393, filed Apr. 20, 1994, now pending.

BACKGROUND OF THE INVENTION

The present invention relates to railway track assemblies and more particularly, to embedded railway track assemblies.

Railway track assemblies typically employ a pair of steel rails supported by a plurality of perpendicularly disposed ties which rest on a ballast material. Often it is desirous to embed the railway tracks so that the top surface of the rails are substantially the same height as the finish grade of the surrounding surface.

When rails are embedded in a surrounding surface, gaps must exist between the rail and the surrounding surface. These gaps permit the wheels of the rail guided vehicle to pass along the rails without obstruction. These gaps also prevent the surrounding surface from contacting the rails, due to construction tolerances or shifting of the surrounding surface area, thereby moving the rails into an unusable out-of-alignment position.

The existence of gaps between a rail and a surrounding surface area causes many problems. One such problem is the possibility of a foreign object becoming wedged in the gap and presenting an obstacle for vehicles traveling along the rail system. Another problem with embedded rail systems is the accumulation and flow of fluids and foreign objects in between the rail and the surrounding surface. These fluids or foreign objects can damage the railway crossing system, such as the ballast, ties, attaching hardware, etc.

For the foregoing reasons, there is a need for embedded railway track systems which help prevent foreign objects and/or materials from passing between the rail and the surrounding surface.

SUMMARY

In accordance with the invention, there is provided an elongated gauge side insert for installation between a gauge panel and a rail of a rail crossing system in which the rail is of the kind having a head, a web, and a flange. The insert is formed of resilient material and includes an elongated main body which has a gauge panel side abuttable against a gauge panel. Furthermore, the main body has a top surface offset downwardly (when the main body is installed) from the top of the rail a distance sufficient to accommodate the flange of a wheel on the rail. The main body also has a bottom surface adapted to rest on and be supported by rail anchors associated with the rail flange on the gauge side thereof. The insert also has an elongated leg projecting from the main body toward the rail and abutting the web thereof when installed. The insert further has a resilient arm projecting from the main body toward the rail and upwardly toward the head of the rail, the resilient arm being positioned above the leg, with resilient arm further having the rail end wedged under and against the rail head when installed. Preferably, the main body is further provided with an upright leg upstanding from the main body and abutting the gauge panel when installed. The gauge side insert main body is further provided with a pin cavity extending lengthwise therethrough for accommodating connecting pins for connecting together two or more inserts endwise.

The invention also includes an elongated field side insert for installation between a field panel and a rail of a rail crossing system in which the rail is of the kind having a head, a web, and a flange. The insert includes a head which has a panel side abuttable against the field panel when installed. It has a top surface positioned at substantially the same height as the top of the rail when installed, which provides a uniform rail sealant/filer block between the panels and the rails. The head further has a rail side conforming in profile shape to and abutting against the side of the head and web of the rail when installed. Furthermore, the insert has a leg extending downwardly from the head in position to abut against the web and flange of the rail when installed and the leg has a bottom end abuttable against the rail fasteners associated with the rail when installed. Preferably, the insert is further provided with at least one elasticity cavity extending lengthwise therethrough for imparting a degree of compressibility thereto and the insert is further provided with a pin cavity extending lengthwise therethrough for accommodating connecting pins for connecting together two or more inserts endwise.

BRIEF DESCRIPTION OF THE DRAWINGS

These and other features, aspects, and advantages of the present invention will become better understood with regard to the following description, appended claims, and accompanied drawings where:

DETAILED DESCRIPTION

Figure 1:
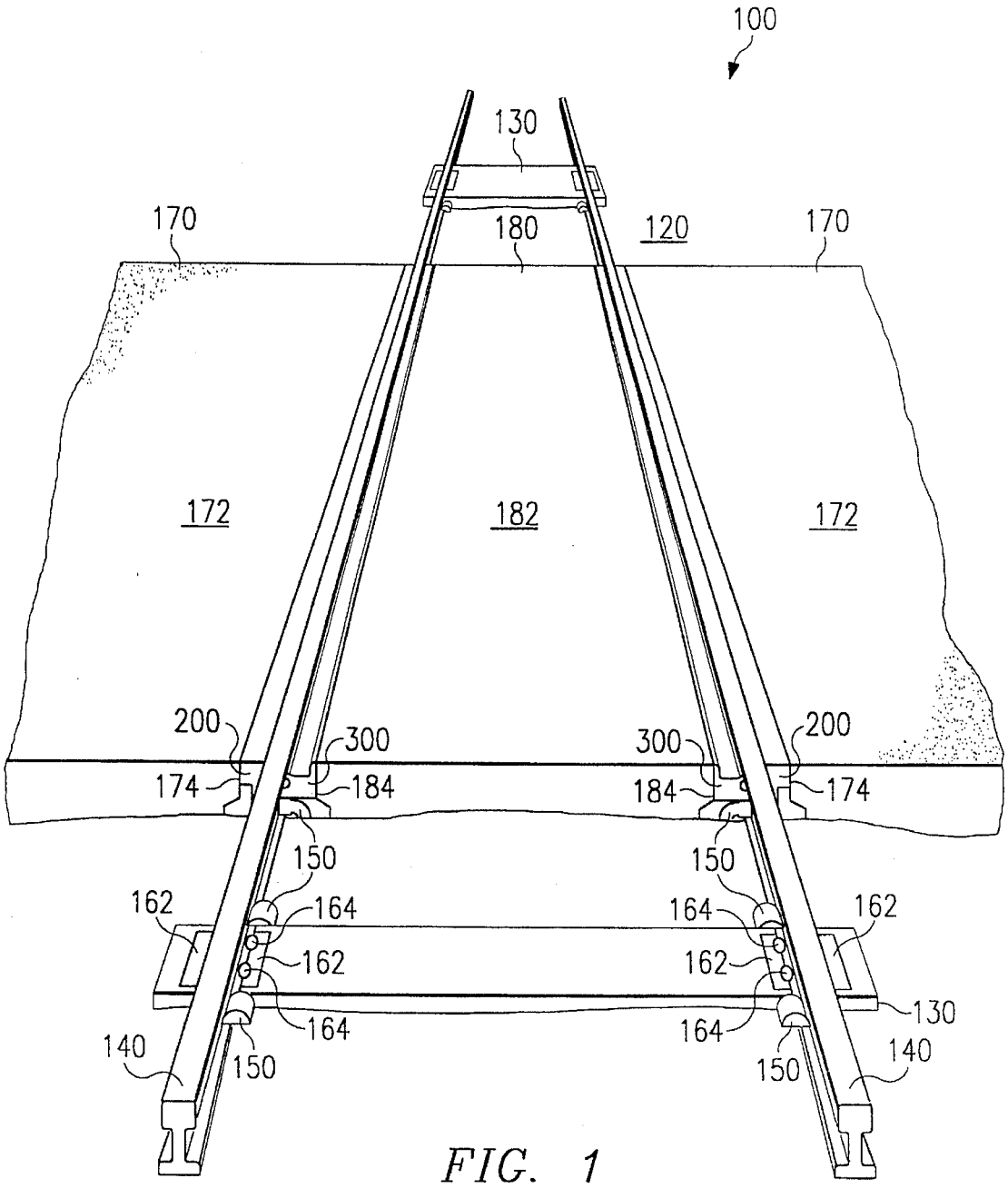
FIG. 1 shows a perspective view, from above, of a railway crossing system in accordance with the present invention.

Referring first to FIG. 1, there is shown a perspective view, from above, of an embedded railway system, generally indicated by 100, in accordance with the present invention. The embedded railway system 100 generally comprises a pair of rails 140 supported on a ballast material 120 by a row of ties 130 which are arranged substantially perpendicular to the rails 140. The ties 130 rest directly on the ballast material 120, and the rails 140 are secured to the ties 130 by hardware which includes a plurality of rail anchors 150, tie plates 162, and rail fasteners 164 such as spikes or clips. Although the embodiment illustrated uses a plurality of rail anchors 150, tie plates 162, and rail fasteners 164 to secure the rails 140 to the ties 130, any fastening hardware can be used which performs the same function of securing the rails 140. The ballast material 120 is a material sufficient for supporting the ties 130, such as gravel, or the like. The ties 130 are constructed of a material strong enough to support the rails 140 and prevent the rails 140 from shifting their position when secured by the rail anchors 150, the tie plates 162, and the rail fasteners 164. Typical materials for the ties 130 include, but are not limited to, wood, concrete, or the like.

Still referring to FIG. 1, it can be seen that the embedded railway system 100 also includes field panels 170, a gauge panel 180, field inserts 200, and gauge inserts 300. The gauge panel 180 is positioned between the rails 140 and has a top surface 182 which is substantially the same height as the rails 140. The field panels 170 are on the outside of the rails 140 and have top surfaces 172 which are substantially the same height as the rails 140. Although the field panels 170 and the gauge panel 180 are described herein as panels, these items can be any material which is used to bring the surface of the area surrounding the rails to approximately the same height as the rails 140. As an example, the field panels 170 and the gauge panel 180 can be constructed of wood, concrete, steel, asphalt, or the like. The field panels 170 have a rail side 174 which face one of the rails 140. Likewise, the gauge panel 180 has rail sides 184 which face the rails 140. The field inserts 200 are elongated members which occupy the space between the rail side 174 of the field panels 170 and the rails 140. Likewise, the gauge inserts 300 are elongated members which occupy the space between the rail sides 184 of the gauge panel 180 and the rails 140. The field inserts 200 and the gauge inserts 300 can be formed of rubber, plastic, felt or the like, but are preferably formed of extruded virgin rubber.

Figure 2:
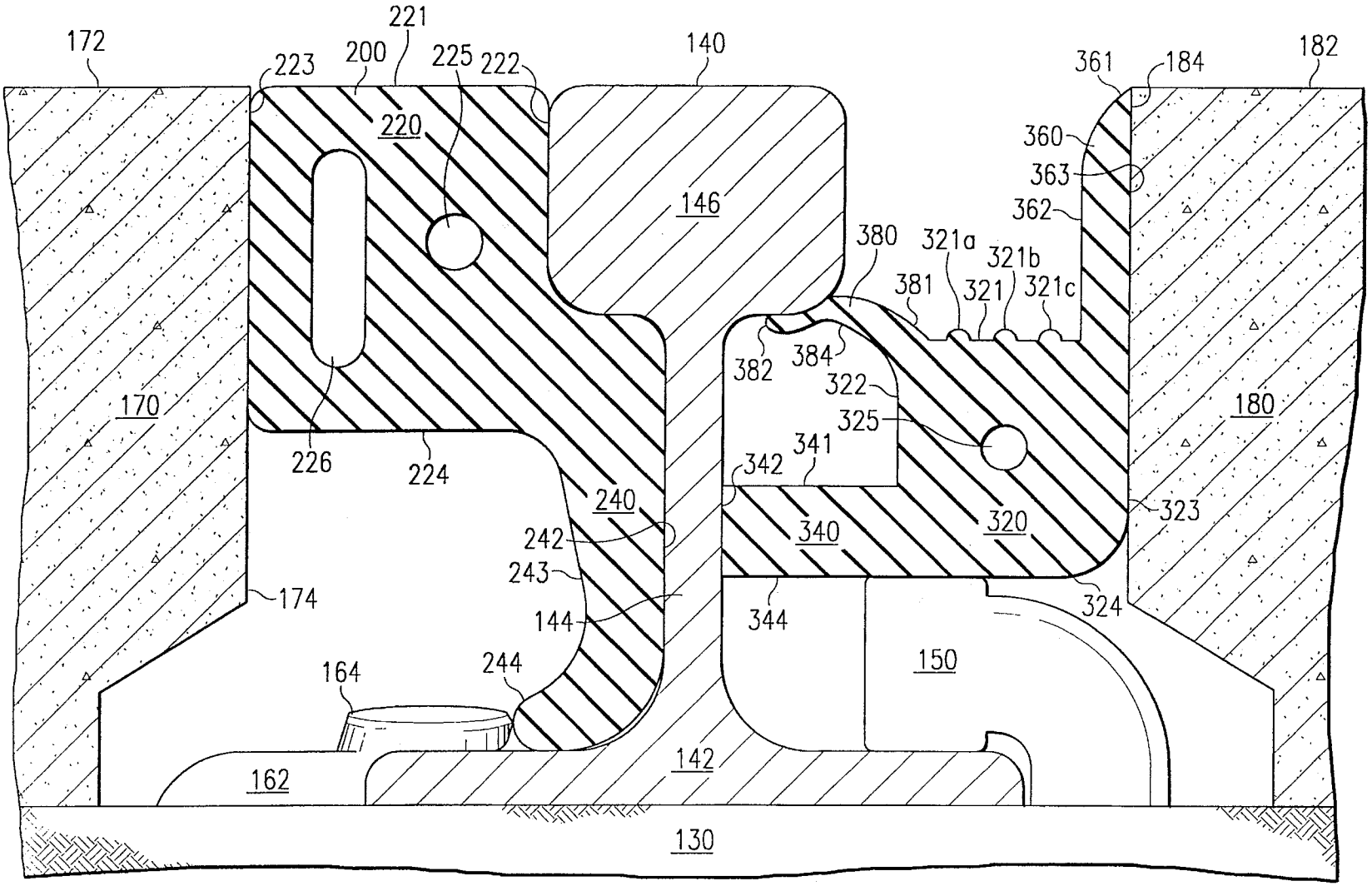
FIG. 2 shows a cross sectional view of a portion around a rail in a system of FIG. 1.

Referring now to FIG. 2, there is shown a cross sectional view of a portion around one of the rails 140 in the embedded railway system of FIG. 1. The rail anchors 150, the tie plates 162, and the rail fasteners 164 secure a rail base 142 of the rail 140 to the ties 130. The rail 140 also has a rail head 146 which is connected to the rail base 142 by a rail web 144. The rail head 146 provides the area of the rail 140 for the wheels of a vehicle traveling on the rails (not shown) to follow.

Still referring to FIG. 2, the field insert 200 is shown in profile and as located between the rail 140 and the rail side 174 of the field panel 170. As shown in FIG. 2, the profile of the field insert 200 comprises a head 220 and a leg 240. The head 220 has a top surface 221 which is positioned at substantially the same height as the rail 140. A rail side 222 of the head 220 contacts the rail 140 and conforms to the rail head 146 and the rail web 144. A panel side 223 of the head 220 engages the rail side 174 of the field panel 170. A bottom surface 224 of the head 220 is positioned sufficiently high that the rail anchors 150, the tie plates 162, and the rail fasteners 164 located below the head 220 will not interfere with the position of the field insert 200. A pin aperture 225 extends longitudinally through the head 220. An elasticity cavity 226 is located in the head 220 near the panel side 223. The elasticity cavity 226 improves the interface of the panel side 223 of the head 220 with the rail side 174 of the field panel 170 by allowing greater compression at the panel side 223 of the head 220.

Referring still to FIG. 2, the leg 240 of the field insert 200 extends below the head 220. A bottom end 244 of the leg 240 preferably abuts the rail fasteners 164 which secure the rail 140. A rail side 242 of the leg 240 extends from the head 220 of the field insert 200 to the bottom end 244 of the leg 240, and preferably conforms to the rail 140. A panel side 243 of the leg 240 extends from the head 220 of the field insert 200 to the bottom end 244 of the leg 240, and is preferably formed to provide clearance for all of the rail anchors 150, the tie plates 162, and the rail fasteners 164, which secure the rail 140.

Still referring to FIG. 2, the gauge insert 300 is shown in profile and as located between the rail 140 and the rail side 184 of the gauge panel 180. As shown in FIG. 2, the profile of the gauge insert 300 comprises a main body 320, a leg 340, an upright arm 360, and a resilient arm 380. The main body 320 is positioned with a top surface 321 located below the rail head 146. The top surface 321 has top surface ribs 321*a*, 321*b*, and 321*c* which face upward. Although the top surface 321 is illustrated in the preferred embodiment with top surface ribs 321*a–c*, any feature could be used in place of the top surface ribs 321*a–c* which would visually identify the top surface 321, such as grooves, markings, or the like. A rail side 322 of the main body 320 is formed to leave a space between the rail web 144 and the main body 320. A bottom surface 324 of the main body 320 is preferably adapted to rest against the rail anchors 150 which are secured to the base 142 of the rail 140. A panel side 323 of the main body 320 is positioned against the rail side 184 of the gauge panel 180. A pin aperture 325 extends longitudinally through the main body 320.

Referring still to FIG. 2, the leg 340 of the gauge insert 300 extends from the rail side 322 of the main body 320. A rail end 342 of the leg 340 contacts the rail web 144 of the rail 140. A top side 341 of the leg 340 extends from the main body 320 of the gauge insert 300 to the rail end 342 of the leg 340, and preferably leaves a space between the leg 340 and the rail head 146. A bottom side 344 of the leg 340 extends from the main body 320 of the gauge insert 300 to the rail end 342 of the leg 340. The bottom side 344 of the leg 340 is preferably parallel with the bottom surface 324 of the main body 320.

Still referring to FIG. 2, the upright arm 360 extends upwardly from the main body 320 of the gauge insert 300. A top end 361 of the upright arm 360 extends to approximately the same height as the top surface 182 of the gauge panel 180. A rail side 362 of the upright arm 360 extends from the main body 320 of the gauge insert 300 to the top end 361 of the upright arm 360, and preferably provides a space between the upright arm 360 and the rail 140. A panel side 363 of the upright arm 360 extends from the main body 320 of the gauge insert 300 to the top end 361 of the upright arm 360, and preferably contacts the rail side 184 of the gauge panel 180.

Referring still to FIG. 2, the resilient arm 380 extends upwardly from the main body 320 and in the same direction as the leg 340. A rail end 382 of the resilient arm 380 is adapted for contacting, and conforming with, a lower portion of the rail head 146. A top surface 381 of the resilient arm 380 extends from the main body 320 of the gauge insert 300 to the rail end 382 of the resilient arm 380. A bottom surface 384 of the resilient arm 380 extends from the main body 320 of the gauge insert 300 to the rail end 382 of the resilient arm 380, and preferably provides a space between the bottom surface 384 of the resilient arm 380 and the top side 341 of the leg 340.

Figure 3:
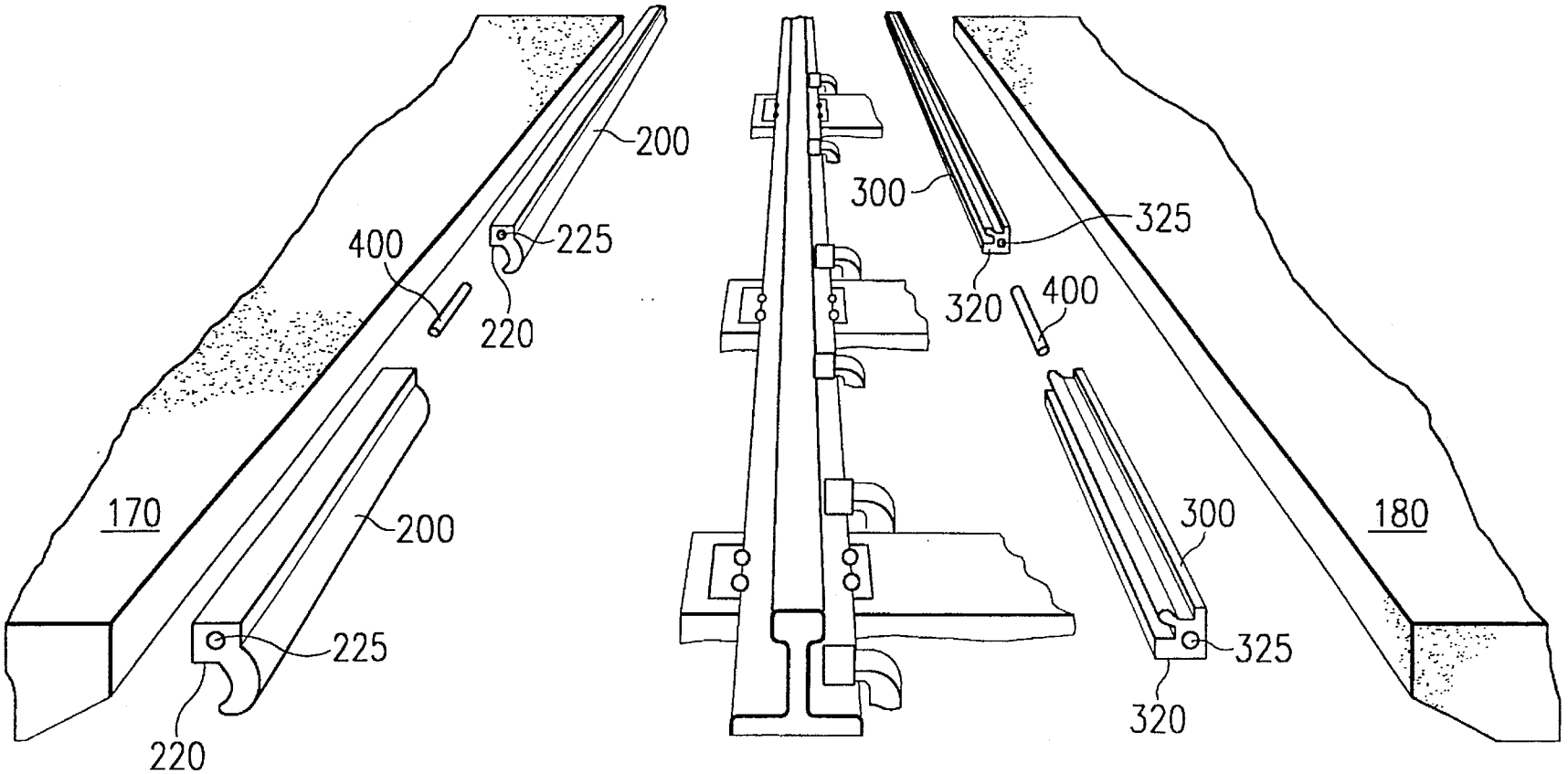
FIG. 3 shows a partial, exploded, perspective view of the railway crossing system in FIG. 1.

Referring now to FIG. 3, there is shown a partial exploded perspective view of the railway crossing system in FIG. 1. It can be seen that two or more sections of the field inserts 200, and the gauge inserts 300, can be joined by pins 400 to fill the gaps between the field panels 170 and the rails 140, and the gaps between the rails 140 and the gauge panel 180. One of the pins 400 is inserted into the pin aperture 225 of two sections of the field insert 200 at the intersection of the two sections. Likewise, one of the pins 400 is inserted into the pin aperture 325 of the gauge insert main body of two sections of the gauge insert 300. The pin aperture 225 of the field insert 200, and the pin aperture 325 of the gauge insert 300, are adapted to grip the pins 400. The pins 400 can be steel pins, or the like, such as reinforcing bar. In this manner, separate sections of the field insert 200, or the gauge insert 300, which are joined together will and act as one continuous section and resist separation or gapping at each end joint. Although the pin aperture 225 and the pin aperture 325 are illustrated in the preferred embodiment as extending longitudinally through the entire length of the field insert 200 and the gauge insert 300, respectively, for the present invention, the pin aperture 225 and the pin aperture 325 only need to extend into the field insert 200 and the gauge insert 300, respectively, a sufficient length to secure the pins 400.

Figure 4:
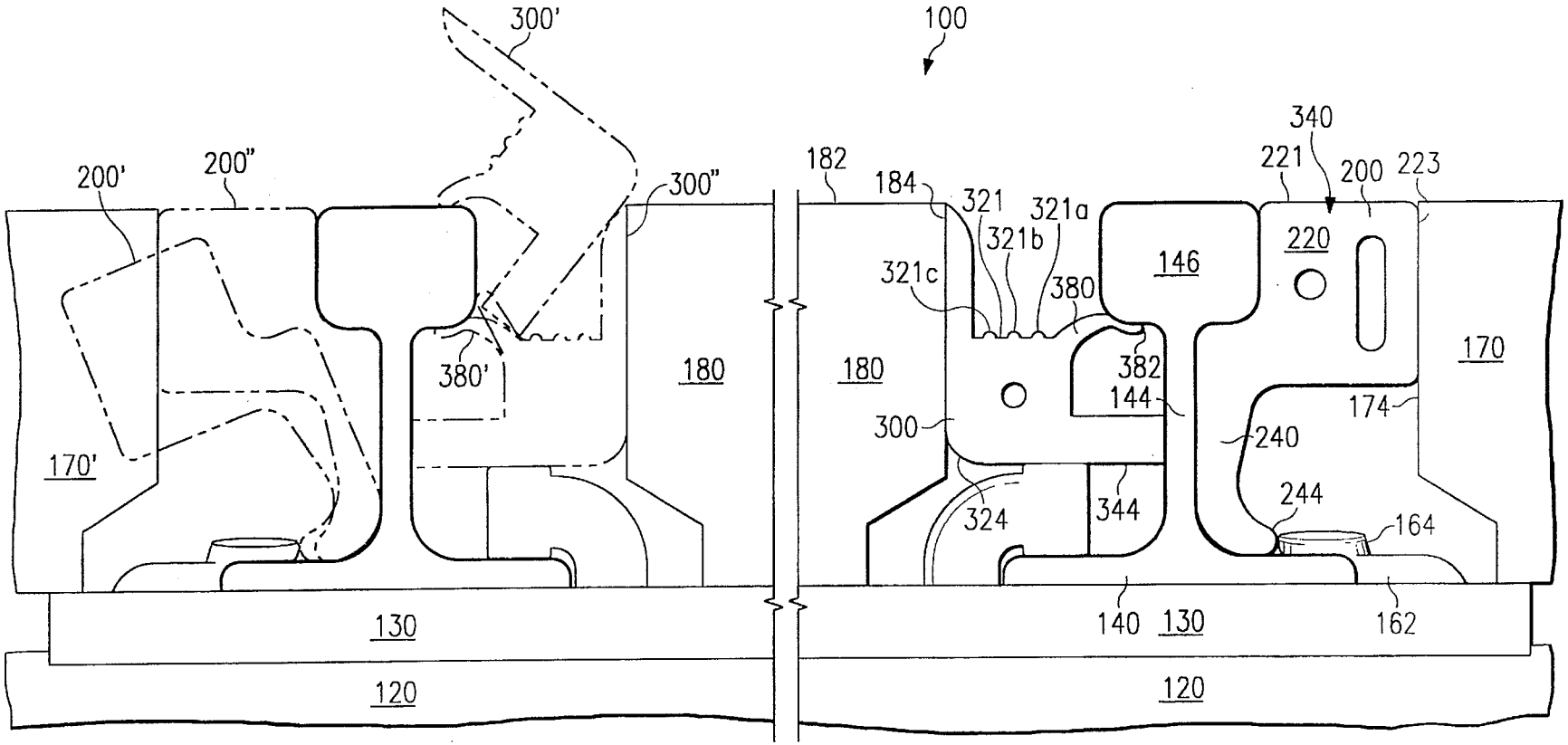
FIG. 4 shows a cross sectional view of the embedded railway system of FIG. 1, illustrating the assembly of that system.

Referring now to FIG. 4, there is shown a cross sectional view of the embedded railway system 100 in FIG.1, illustrating the assembly of the embedded railway system 100. The ballast material 120 is graded to a uniform level, and the ties 130 are spaced apart thereon. The rails 140 are positioned parallel to each other and perpendicular to the ties 130. The rail anchors 150, the tie plates 162, and the rail fasteners 164 secure the rails 140 to the ties 130. After the rails 140 are secured to the ties 130, the gauge panel 180 is positioned in between the rails 140.

Still referring to FIG. 4, the gauge insert 300 is located in a position 300' with the leg 340 between the rail 140 and the rail side 184 of the gauge panel 180. The gauge insert 300 is rotated and then pressed downward into a position 300". In the position 300" of the gauge insert 300, the main body 320 of the gauge insert 300 is below the top surface 182 of the gauge panel 180, and the top surface ribs 321*a–c* of the main body 320 face upward. Preferably, the bottom surface 324 of the main body 320 rests against the rail anchors 150 in the position 300". After the gauge insert 300 is pushed downward into the position 300", the resilient arm 380 is pushed toward the rail web 144 until the rail end 382 of the resilient arm 380 is moved into a position 380' with the rail end 382 of the resilient arm 380 contacting the lower surface of the rail head 146. The same procedure is repeated for both gauge sides of the embedded railway system 100.

Still referring to FIG. 4, the field insert 200 is positioned against the rail 140 with the bottom end 244 of the leg 240 between the rail fastener 164 and the rail 140. The field insert 200 is then pivoted about the bottom end 244 of the leg 240 from a position 200' to a position 200" where the top surface 221 is at substantially the same height as the rail head 146. After the field insert 200 is rotated to the position 200", the field panel 170 is located in a position 170' with the rail side 174 of the field panel 170 contacting the panel side 223 of the head 220 of the field insert 200. The same procedure is repeated for both field sides of the embedded railway system 100.

Figure 5:
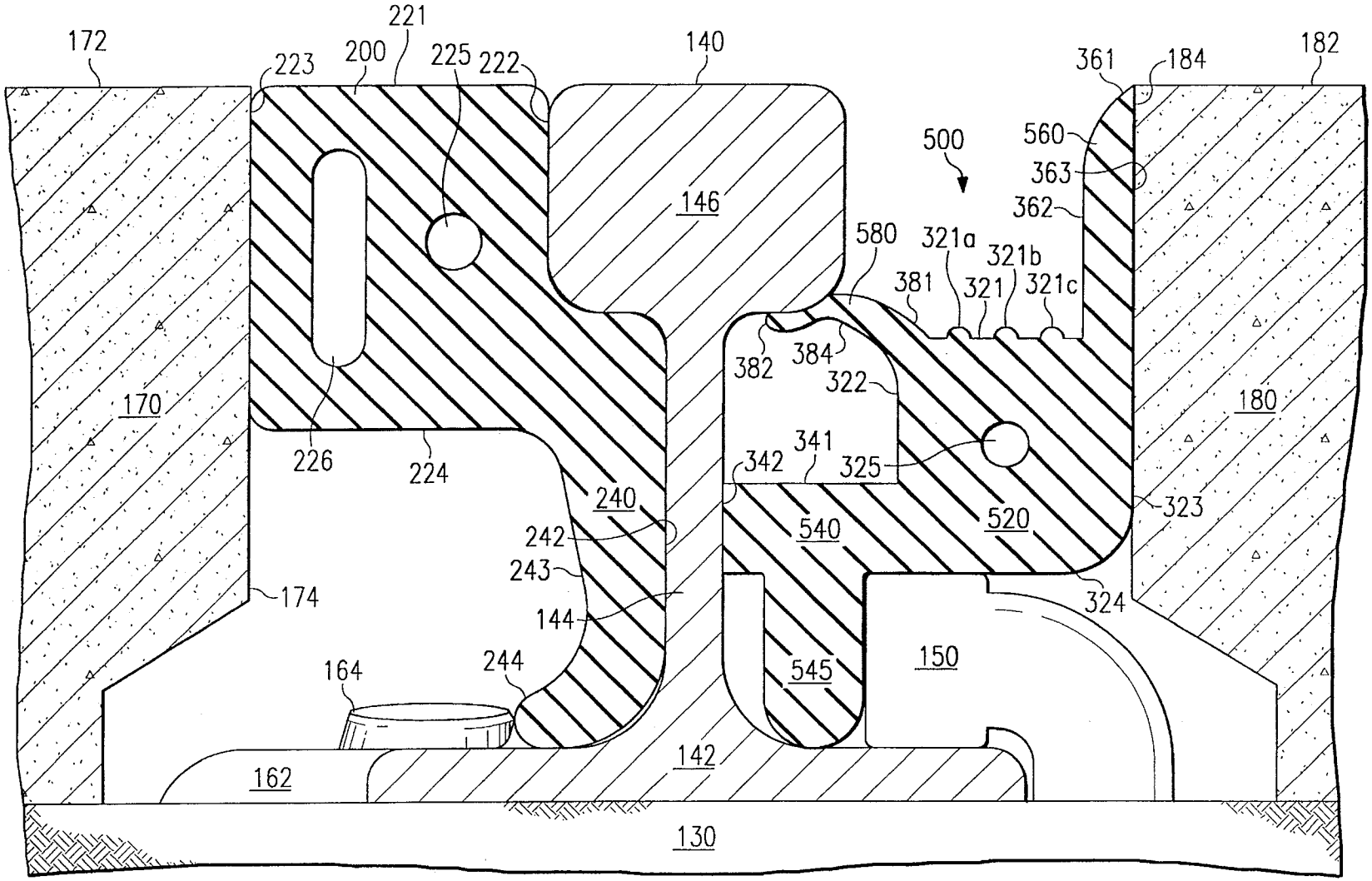
FIG. 5 shows a partial cross sectional view of an alternate embodiment a gauge insert of the present invention.

Referring now to FIG. 5, there is shown a partial cross sectional view of an alternate embodiment of the gauge insert of the present invention, indicated generally at 500. Similar to the gauge insert 300 in FIG. 1, the gauge insert 500 has a main body 520, a leg 540, an upright arm 560, and a resilient arm 580. The main body 520, the leg 540, the upright arm 560, and the resilient arm 580 have the same features and functions as the main body 320, the leg 340, the upright arm 360, and the resilient arm 380, respectively, of the gauge insert 300 in FIG. 2. However, the leg 540 also includes a lobe 545 extending below the leg 540. It is preferred that the lobe 545 extend below the leg 540 with sufficient length to rest on the rail base 142 of the rail 140, or abut against the rail anchor 150, or both. In this manner, the leg 545 will support the guage insert 500, or prevent the guage insert 500 rotating, or both.

Referring now to FIGS. 1–5, it can be seen that the top of the rail head 146 is substantially the same height as the top surface 182 of the gauge panel 180 and the top surface 172 of the field panels 170. The substantially uniform height of the rails 140, the gauge panel 180, and the field panels 170 provide an embedded railway system 100 which allows vehicles travelling on the rails 140 to pass without obstruction, and allows vehicles crossing the rails to pass with a minimum of obstruction due to the rails 140 themselves. The field inserts 200 present a uniform rail sealant/filler block between the field panels 170 and the rails 140, but allow variances in the distance between the field panels 170 and the rails 140 due to construction tolerances, shifting components, etc. The gauge inserts 300 and 500 reduce the accumulation and passage of fluids and other foreign objects in the space between the gauge panel 180 and the rails 140, and allows the retaining flange of the wheels (not shown) for a vehicle travelling on the rails 140 to pass without obstruction due to the lowered position of the top surface 321 of the main body 320, 520. The gauge inserts 300, 500 also allow variances in the distance between the gauge panel 180 and the rails 140 due to construction tolerances, shifting components, etc. Furthermore, the top surface ribs 321*a–c* of the main body 320, 520 provide a visual indication that the gauge insert as installed in the correct orientation.

It is thus believed that the operation and construction of the present invention will be apparent from the foregoing description of a preferred embodiment. While the method and apparatus shown or described as being characterized as being preferred, it will be obvious to a person of ordinary skill in the art that various changes and modifications may be made therein without departing from the spirit and scope of the invention as defined in the following claims.

What is claimed is:

1. A method of installing an elongated member having a profile with a main body, a leg, and a resilient arm, in a space between a rail and surrounding surface, said method comprising the steps of:

positioning the elongated member with the leg extending downward between the rail and the surrounding surface;

inserting the elongated member into the space between the rail and the surrounding surface by rotating the elongated member until the main body and the leg are between the rail and the surrounding surface and pressing the elongated member downward until the main body and the leg of the elongated member are vertically positioned between the rail and the surrounding surface; and positioning the resilient arm of the elongated member by pressing the resilient arm below a head of the rail.

2. method of installing an elongated member as claimed in claim 1, further comprising the steps of:

forming said elongated member as two elongated member sections having ends with pin apertures extending longitudinally therein;

inserting a first end of a pin into the pin aperture of a first of the two elongated member sections;

inserting the second end of the pin into the pin aperture of a second of the elongated member sections until the end of the first elongated member section abuts with the end of the second elongated member section.

* * * * *